United States Patent [19]

Bianchi et al.

[11] 4,003,817

[45] Jan. 18, 1977

[54] VALVE METAL ELECTRODE WITH VALVE METAL OXIDE SEMI-CONDUCTIVE COATING HAVING A CHLORINE DISCHARGE IN SAID COATING

[75] Inventors: Giuseppe Bianchi, Milan, Italy; Vittorio de Nora, Nassau, Bahamas; Patrizio Gallone; Antonio Nidola, both of Milan, Italy

[73] Assignee: Diamond Shamrock Technologies, S.A., Geneva, Switzerland

[22] Filed: Sept. 23, 1974

[21] Appl. No.: 508,232

Related U.S. Application Data

[60] Division of Ser. No. 141,946, May 10, 1971, Pat. No. 3,846,273, which is a continuation-in-part of Ser. Nos. 690,407, Dec. 14, 1967, Pat. No. 3,616,445, and Ser. No. 771,665, Oct. 29, 1968, Pat. No. 3,948,751.

[52] U.S. Cl. ..... 204/290 F

[51] Int. Cl.[2] ..... C25B 11/06; C25B 11/08; C25B 11/10

[58] Field of Search ..... 204/290 F, 290 R

[56] References Cited

UNITED STATES PATENTS

| | | | |
|---|---|---|---|
| 3,491,014 | 1/1970 | Bianchi et al. | 204/242 |
| 3,562,008 | 2/1971 | Martinson | 117/221 |
| 3,616,445 | 10/1971 | Bianchi et al. | 204/290 F |
| 3,632,497 | 1/1972 | Leduc | 204/263 |
| 3,632,498 | 1/1972 | Beer | 204/290 F |
| 3,810,770 | 5/1974 | Bianchi et al. | 106/286 |
| 3,846,273 | 11/1974 | Bianchi et al. | 204/209 F |
| 3,878,083 | 4/1975 | de Nora et al. | 204/290 F |

FOREIGN PATENTS OR APPLICATIONS

| | | | |
|---|---|---|---|
| 1,147,442 | 11/1966 | United Kingdom | 204/290 F |
| 1,195,871 | 6/1970 | United Kingdom | 204/290 F |

*Primary Examiner*—F.C. Edmundson

*Attorney, Agent, or Firm*—Hammond & Littell

[57] ABSTRACT

Describes chlorine resistant metal electrodes, preferably of valve metals such as titanium and tantalum, having coatings of mixed metal oxides, preferably valve metal oxides, which have been doped to provide semi-conducting surfaces on the electrodes, which coatings also have the capacity to catalyze chlorine discharge from the electrodes and to resist corrosive conditions in a chlorine cell.

21 Claims, No Drawings

VALVE METAL ELECTRODE WITH VALVE METAL OXIDE SEMI-CONDUCTIVE COATING HAVING A CHLORINE DISCHARGE IN SAID COATING

This application is a division of application Ser. No. 141,946, filed May 10, 1971, now U.S. Pat. No. 3,846,273, which is a continuation-in-part of our copending applications Ser. No. 690,407, filed Dec. 14, 1967 now Pat. No 3,616,445 and Ser. No. 771,665, filed Oct. 29, 1968 Pat. No. 3,948,751.

This invention relates to valve metal electrodes having a semi-conductive coating of titanium dioxide or tantalum oxide or other metal oxides, which is sufficiently conductive to avoid, for a long period of time, the passivation which takes place in valve metal electrodes or in valve metal electrodes having a coating of a platinum group metal thereon, when used in electrolysis processes such as, for example, the production of chlorine, and in which the semi-conductive titanium dioxide or tantalum oxide or other metal oxide coating also contains an electrocatalytic material sufficient, for example, to catalyze chlorine discharge from the electrode. The electrode is sufficiently conductive to conduct electrolysis current from the electrode base to an electrolyte at continued high amperage and lower overvoltage for chlorine discharge for long periods of time.

The electrodes of our invention may be used for the electrolysis of lithium, sodium and potassium chlorides, bromides and iodides and more generally for the electrolysis of halogenides, for the electrolysis of other salts which undergo decomposition under electrolysis conditions, for the electrolysis of HCl solutions and for the electrolysis of water, etc. They may also be used for other purposes such as other processes in which an electrolysis current is passed through an electrolyte for the purpose of decomposing the electrolyte, for carrying out organic oxidations and reductions, for cathodic protection and in other electrolysis processes. They may be used in mercury or diaphragm electrolysis cells and may take other forms than those specifically described. The electrodes of our invention are particularly useful as anodes for the electrolysis of sodium chloride brines in mercury cells and diaphragm cells as they have the ability to catalyze the oxidation of dissolved chloride ions to molecular chlorine gas and to liberate chlorine at low anode voltages essentially throughout the life of the titanium dioxide or tantalum oxide or other metal oxide semi-conductor coating and have a low wear rate (loss of conductor coating metal per ton of chlorine produced).

Valve metals, such as titanium, tantalum, zirconium, molybdenum, niobium and tungsten, have the capacity to conduct current in the anodic direction and to resist the passage of current from the cathodic direction and are sufficiently resistant to the electrolyte and conditions within an electrolytic cell used, for example, for the production of chlorine and caustic soda, to be used as electrodes in electrolytic processes. In the anodic direction, however, their resistance to the passage of current goes up rapidly, due to the formation of an oxide layer thereon, so that it is no longer possible to conduct current to the electrolyte in any substantial amount without substantial increase in voltage which makes continued use of uncoated valve metal anodes in the electrolytic process uneconomical.

When valve metal anodes are coated with platinum or platinum group metal conductors, these too become passivated causing a rapid rise in potential after being used for a short time at sufficiently high current density under chlorine discharge. This rise in potential is probably due to the deposition of an adsorbed layer of oxygen on the platinum group metal electrodes and indicates that the anodic oxidation of the dissolved chlorine ion to molecular chlorine gas (electrocatalytic activity) will proceed only at a higher overvoltage because of the diminished catalytic activity of the electrode surface.

Attempts to overcome this passivation (after a short period of use) by providing titanium or tantalum anodes with a coating of a platinum group metal applied by electro-deposition or by thermal processes, but essentialy covering the entire face of the titanium anode facing the cathode, have not been commercially successful. The coatings did not always adhere properly and the consumption of the platinum group metal was high and the results were unsatisfactory.

It has long been known that rutile or titanium dioxide and tantalum oxide have semi-conducting properties, either when doped with traces of other elements or compounds which disturb the lattice structure and change the conductivity of the titanium dioxide or tantalum oxide, or when the lattice is disturbed by the removal of oxygen from the titanium dioxide or tantalum oxide crystal. Titanium dioxide has been doped with tantalum, niobium, chromium, vanadium, tin, nickel and iron oxides and other materials to change the electrical conducting or the semi-conducting properties of the titanium dioxide and has been rendered semi-conducting by changing the stoichiometric balance of the $TiO_2$ crystals, by removing oxygen from the crystal lattice. Likewise, $Ta_2O_5$ films have had their conductivity altered by ultraviolet radiation and by other methods.

It is known, for example, that when chemically pure titanium dioxide is doped with 1 mole % of $Nb_2O_5$, its specific conductance is increased from 60 ohm-cm$^1$ × $10^{-9}$ to 330.000 ohm-cm$^1$ × $10^{-9}$ when measured at 250° C, a 5500 fold increase. Likewise, when chemically pure titanium dioxide is doped with 1 mole % of $Ta_2O_5$, the specific conductance of the $TiO_2$ is increased 4166 fold. No one, however, has suggested the use of doped titanium dioxide or tantalum oxide to provide a conductive or semi-conductive face on a valve metal electrode for use in electrochemical reactions, nor has anyone suggested incorporating an electrocatalytic agent in such doped semi-conducting coatings to promote chlorine discharge from the anode.

Other metal oxides than $TiO_2$ and $Ta_2O_5$ when intimately mixed and heated together have the property of forming semi-conductors, particularly mixed oxides of metals belonging to adjacent groups in the Periodic Table.

Various theories have been advanced to explain the conductive or semi-conductive properties of doped or undoped titanium dioxide, also for $Ta_2O_5$. See, for example, Grant, Review of Modern Physics, Vol. 1, page 646 (1959); Frederikse, Journal of Applied Physics, Supplement to Vol. 32, No. 10, page 221 (1961) and Vermilyea, Journal of the Electrochemical Society, Vol. 104, page 212 (1957), but there appears to be no general agreement as to what gives doped titanium dioxide and tantalum oxide their properties of semiconduction. When other mixed metal oxides are used to produce semi-conductors, it seems probable that oxides of one metal belonging to an adjacent group in the Periodic Table penetrates into the crystal lattice of the other metal oxide by solid solution to act as a doping oxide which disturbs the stoichiometric structure of the crystals of one of the metal oxides to give the mixed oxide coating its semi-conducting properties.

The doping oxide is usually used in amounts of less than 50 mole% of the doped oxide and should be of a greater or lesser normal valence than the oxide to be doped. Oxides of the same valence and substantially the same atomic radii and lattice parameters as $TiO_2$ or $Ta_2O_5$ do not act as doping agents for $TiO_2$ or $Ta_2O_5$ but may form mixed crystals with $TiO_2$. The doping oxide as well as the doped oxide must be resistant to the conditions encountered in an electrolysis cell used for any given purpose and must be capable of protecting any electrocatalytic material incorporated in the coating.

One of the objects of this invention is to provide an electrode having a metal base and a semi-conducting mixed metal oxide coating over part or all of said base, sufficient to conduct an electrolysis current from said base to an electrolyte over long periods of time without passivation.

Another object is to provide an anode having a valve metal base with a coating over part or all of the surface thereof, consisting primarily of titanium dioxide or tantalum oxide which has conducting or semi-conducting properties sufficient to conduct an electrolysis current from the base to an electrolyte over long periods of time without passivation.

Another object of the invention is to provide a valve metal electrode having a conducting surface consisting primarily of titanium dioxide or doped titanium dioxide or tantalum oxide or doped tantalum oxide or mixed metal oxides from adjacent groups in the Periodic Table.

Another object of our invention is to provide a valve metal electrode having a semi-conductive coating consisting primarily of titanium dioxide or tantalum oxide or mixed metal oxides in which the semi-conductive coating has an electrocatalytic chlorine discharge catalyst incorporated therein or has the properties of catalyzing chlorine discharge from the surface of the electrode without increase in overvoltage as hereindefined over long periods of time.

Another object of our invention is to provide a metal electrode having a semi-conducting face of doped titanium dioxide or doped tantalum oxide or doped metal oxides in which the metal oxide and the doping oxide are baked on the cleaned electrode face to cause a solid solution to be formed between the titanium dioxide or tantalum oxide or the metal oxide and the doping composition which will resist separation of the semi-conducting face from the metal electrode base.

Another object of our invention is to provide a valve metal electrode having a semi-conducting face of doped titanium dioxide or doped tantalum oxide or other doped metal oxide in which the doping composition and the doped metal oxide are baked on the cleaned electrode face in multiple layers to cause a solid solution to be formed between the titanium dioxide, tantalum oxide or other metal oxide and the doping composition and any electrocatalytic agent incorporated in the coating.

Another object of our invention is to provide a valve metal electrode with a valve metal oxide semi-conductor coating which will have greater adherence to the base than the platinum group metal coatings of the prior art.

Various other objects and advantages of our invention will appear as this description proceeds.

In general, we prefer to make a solution of the semiconductor metal and the doping composition in such form that when applied and baked on the cleaned valve metal electrode the solution will form $TiO_2$ plus doping oxide or $Ta_2O_5$ plus doping oxide or other metal oxide plus doping oxide and to bake this composition on the valve metal electrode in multiple layers so as to form a solid solution of the $TiO_2$, $Ta_2O_5$ or other metal oxide and the doping oxide on the face of the electrode which will have the desired semi-conducting properties, will have electrocatalytic properties and will continue chlorine discharge without increase in overvoltage over long periods of time. Any solutions or compounds which on baking will form $TiO_2$ plus doping oxide, $Ta_2O_5$ plus doping oxide or other metal oxide plus doping oxide may be used, such as, chlorides, nitrates, sulfides, etc., and the solutions given below are only by way of example.

"Overvoltage" as used above may be defined as the voltage in excess of the reversible or equilibrium E.M.F. which must be applied to cause the electrode reaction to take place at the desired rate. Chlorine overvoltage varies with the anode material and its physical condition. It increases with anode current density but decreases with increase in temperature.

Titanium dioxide, tantalum oxide and other metal oxide semi-conductor faces may be produced by doping titanium dioxide, tantalum oxide or other metal oxide crystals with various doping compositions or by disturbing the stoichiometric lattice by removing oxygen therefrom to cause the $TiO_2$, $Ta_2O_5$ or other metal oxides to become semi-conductive. Because of the tendency of the $TiO_2$, $Ta_2O_5$ or other metal oxide crystals to become reoxidized, we prefer to form the semiconductive faces on our electrodes by the use of doping compositions which on baking form solid solutions with the $TiO_2$, $Ta_2O_5$ or other metal oxide crystals which are more resistant to change during electrolysis processes. However, semi-conducting coatings produced by withdrawing oxygen from the $TiO_2$, $Ta_2O_5$ or other oxide lattices to cause lattice defects or deficiencies may be used on our electrodes.

Various doping materials which introduce impurities into the $TiO_2$ and $Ta_2O_5$ crystals to make them semiconductive, may be used to increase the conductivity and electrocatalytic properties of the $TiO_2$ and $Ta_2O_5$ layer on the electrode, such as, $WO_3$, $P_2O_5$, $Sb_2O_5$, $V_2O_5$, $Ta_2O_5$, $Nb_2O_5$, $B_2O_3$, $Cr_2O_3$, BeO, $Na_2O$, CaO, SrO, $RuO_2$, $IrO_2$, $PbO_2$, $OsO_2$, $PtO_2$, $AuO_2$, $AgO_2$, $SnO_2$, $Al_2O_3$, and mixtures thereof. The doping mixtures for $TiO_2$, for example, may be $WO_3$, $P_2O_5$, $Sb_2O_5$, $V_2O_5$, $Ta_2O_5$, $Nb_2O_5$, $B_2O_3$, $Cr_2O_3$, BeO, $Na_2O$, CaO, SrO, $MoO_3$, $PbO_2$, $AuO_2$, $AgO_2$, $SnO_2$, $Fe_2O_3$, $NiO_2$, $Co_2O_3$, $SnO_2$, $LaO_3$, and mixtures thereof (with or without $RuO_2$, $IrO_2$, $OsO_2$, $PtO_2$ and other platinum group metals as electrocatalytic agents). The doping materials for $Ta_2O_5$ may be, for example $WO_3$, BeO, $Na_2O$, CaO, SrO, $RuO_2$, $IrO_2$, $PbO_2$, $OsO_2$, $PtO_2$, $AuO_2$, $AgO_2$, $SnO_2$, $PtO_2$ and mixtures thereof. The doping oxide should be of a higher or lower normal atomic valence than $TiO_2$ or $Ta_2O_5$ although the valences themselves may vary with the condition of the compound the doping oxide is in, as, for example, when titanium has been converted into the pertitanate or peroxyhydrate, as described in Examples I to III, V, VI, VIII, IX, XII and XIX to XXI. The presence of impurities in commercial titanium and tantalum may affect the conductivity or semi-conductivity of the oxides of these metals. In the case of $TiO_2$, the oxides of the platinum group metals (i.e., platinum, ruthenium, iridium, palladium, osmium and rhodium) act mainly electrocatalytically since they have the same valence and tetragonal rutile-type structure with similar unit cell dimensions and approximately the same cationic radii (0.68 A) as $TiO_2$ crystals. $RuO_2$ (0.65 A) and $IrO_2$ (0.66 A) are especially suitable as electrocatalysts in this context. $IrO_2$ forms solid solutions in $TiO_2$ up to about 5 mole percent $IrO_2$ when heated together at 1040° C. At lower temperatures, the amount of $IrO_2$ which will form solid solutions in $TiO_2$ is lower but the amount of platinum metal oxide group which is not in solid solution continues to act as a catalyst for chlorine discharge.

Oxides of metals from Group VIII of the Periodic Table of elements as well as oxides of metals of Group VB, Group VIB, oxides of metals from Group IB and oxides of elements from Group VA, as well as mixtures of these oxides capable on baking of forming doped semi-conductive crystals of $TiO_2$ and $Ta_2O_5$ and of interrupting the crystal lattice of $TiO_2$ and $Ta_2O_5$ may be used to form semi-conductor and electrocatalytic materials may be added to the valve metal electrode coatings.

In forming semi-conductor coatings for valve metal electrodes from other metal oxides, it is preferable to use mixed oxides of metals, or materials which form mixed oxides of metals, from adjacent groups of the Periodic Table, such as, for example, iron and rhenium; titanium, tantalum and vanadium; titanium and lanthanum. Other oxides which may be used are manganese and tin; molybdenum and iron; cobalt and antimony; rhenium and manganese and other metal oxide compositions.

The percentage of the doping compositions may vary from 0.10 to 50% of the $TiO_2$, $Ta_2O_5$ or other metal oxide and surprising increases in conductivity of the $TiO_2$, $Ta_2O_5$ or other metal oxide facing can be gotten with as little as 0.25 to 1 weight% of the doping composition to the $TiO_2$, $Ta_2O_5$ or other metal oxide in the conductor face on the electrode. In addition to the doping metal oxide, we prefer to provide a coating on our anodes which will catalyze chlorine discharge without material overvoltage, if the electrode is to be used for chlorine production.

The semi-conductive coating of our invention may be applied in various ways, and to various forms of titanium or tantalum base anodes, such as solid rolled massive perforated titanium plates, slitted, reticulated, titanium plates, titanium mesh and rolled titanium mesh, woven titanium wire or screen, titanium rods and bars or similar tantalum and other metal plates and shapes. Our preferred method of application is by chemi-deposition in the form of solutions painted, dipped or sprayed on or applied as curtain or electrostatic spray coatings, baked on the anode base, but other methods of application, including electrophoretic deposition or electrodeposition, may be used. Care must be taken that no air bubbles are entrapped in the coating and that the heating temperature is below that which causes warping of the base material.

The spectrum of doped $TiO_2$ samples shows that the foreign ion replaces the Ti ion on a regular lattice site and causes a hyperfine splitting in accordance with the nuclear spin of the substituting element.

In all applications, the titanium, tantalum or other metal base is preferably cleaned and free of oxide or other scale. This cleaning can be done in any way, by mechanical or chemical cleaning, such as, by sand blasting, etching, pickling or the like.

The following examples are by way of illustration only and various modifications and changes may be made in the compositions and form of solutions given, and in the baking procedure used and in other steps within the scope of our invention.

EXAMPLE I

An expanded titanium anode plate, with a surface of 50 $cm^2$ projected area, was cleaned by boiling at reflux temperature of 110° C in a 20% solution of hydrochloric acid for 40 minutes. It was then given a liquid coating containing the following materials:

| | |
|---|---|
| Ruthenium as $RuCl_3 . H_2O$ | 10 mg (metal) |
| Iridium as $(NH_4)_2 IrCl_6$ | 10 mg (metal) |
| Titanium as $TiCl_3$ | 56 mg (metal) |
| Formamide ($HCONH_2$) | 10 to 12 drops |
| Hydrogen peroxide ($H_2O_2$ 30%) | 3 to 4 drops |

The coating was prepared by first blending or mixing the ruthenium and iridium salts containing the required amount of Ru and Ir in a 2 molar solution of hydrochloric acid (5 ml are sufficient for the above amounts) and allowing the mixture to dry at a temperature not higher than 50° C until a dry precipitate is formed. Formamide is then added to the dry salt mixture at about 40° C to dissolve the mixture. The titanium chloride, $TiCl_3$, dissolved in hydrochloric acid (15% strength commercial solution), is added to the dissolved Ru-Ir salt mixture and a few drops of hydrogen peroxide (30% $H_2O_2$) are added, sufficient to make the solution turn from the blue color of the commercial solution of $TiCl_3$, to an orange color.

This coating mixture was applied to both sides of the cleaned titanium anode base, by brush, in eight subsequent layers, taking care to brush the coating into the interstices of the expanded plate. After applying each layer, the anode was heated in an oven under forced air circulation at a temperature between 300° C for 10 to 15 minutes, followed by fast natural cooling in air between each of the first seven layers, and after the eighth layer was applied the anode was heated at 450° C for one hour under forced air circulation and then cooled.

The amounts of the three metals in the coating correspond to the weight ratios of 13.15% Ir, 13.15% Ru and 73.7% Ti and the amount of noble metal in the coating corresponds to 0.2 mg Ir and 0.2 mg Ru per square centimeter of projected electrode area. It is believed that the improved qualities of this anode are due to the fact that although the three metals in the coating mixture are originally present as chlorides, they are co-deposited on the titanium base in oxide form. Other solutions which will deposit the metals in oxide form may of course be used. In accelerated testing, the anode of this example showed a weight loss of zero after three current reversals, a loss of 0.152 mg/$cm^2$ after three amalgam dips as against a weight loss of 0.93 mg/$cm^2$ of a similar titanium base anode covered with ruthenium oxide. After 2,000 hours of operation this anode showed a weight increase of 0.7 mg/$cm^2$, whereas similar anodes covered with a layer of platinum or ruthenium oxide showed substantial weight losses. The weight increase had apparently become stabilized.

EXAMPLE II

The coating mixture was applied to a cleaned titanium anode base of the same dimensions as in Example I according to the same procedure. The applied mixture consisted of the following amounts:

| | |
|---|---|
| Ruthenium as $RuCl_3 . H_2O$ | 20 mg (metal) |
| Iridium as $(NH_4)_2 IrCl_6$ | 20 mg (metal) |
| Titanium as $TiCl_3$ | 48 mg (metal) |
| Formamide ($HCONH_2$) | 10 to 12 drops |
| Hydrogen peroxide ($H_2O_2$ 30%) | 3 to 4 drops |

The procedure for compounding the coating and applying it to the titanium base was the same as in Example I. The quantities of the three metals in this mixture corresponded to the weight ratios of 22.6% Ir, 22.6% Ru and 54.8% Ti and the amount of noble metal oxide in the active coating corresponded to 0.4 mg Ir, and 0.4 mg Ru per square centimeter of the active electrode area. After 2,300 hours of operation this anode showed a weight increase of 0.9 mg/cm$^2$ which had apparently become stabilzed.

EXAMPLE III

Before being coated, a titanium anode substrate after pre-etching as described in Example I, was immersed in a solution composed of 1 molar solution of $H_2O_2$ plus a 1 molar solution of NaOH at 20° to 30° C for 2 days. The surface of the titanium was thus converted to a thin layer of black titanium oxide.

The coating mixture of the same composition as given in Example II was used, except that isopropyl alcohol was used as the solvent in place of formamide. The use of isopropyl alcohol resulted in a more uniform distribution of the coating films on the black titanium oxide substrate than when formamide was used as the solvent.

The presence of iridium as $IrO_2$ in the mixed $TiO_2$ — $RuO_2$ crystals of the coating of Examples I, II and III is beneficial for chlorine evolution because of its hindrance effect on oxygen vacancy saturation. The conductivity of the mixed $TiO_2$ — $RuO_2$ oxides is due to oxygen vacancies and free electrons, and when the oxygen vacancies are saturated by oxygen evolution within an electrolysis cell, the conductivity of the coating on the electrode decreases.

EXAMPLE IV

An expanded titanium anode plate of the same size as in the former examples was submitted to the cleaning and etching procedure as described above and then given a liquid coating containing the following materials:

| | |
|---|---|
| Ruthenium as $RuCl_3 . H_2O$ | 10 mg (metal) |
| Iridium as $IrCl_4$ | 10 mg (metal) |
| Tantalum as $TaCl_5$ | 80 mg (metal) |
| Isopropyl alcohol | 5 drops |
| Hydrochloric acid (20%) | 5 ml |

The coating was prepared by first blending or mixing the ruthenium and iridium salts in 5 ml of 20% HCl. The volume of this solution was then reduced to about onefifth by heating at a temperature of 85° C. The required amount of $TaCl_5$ was dissolved in boiling 20% HCl so as to form a solution containing about 8% $TaCl_5$ by weight. The two solutions were mixed together and the overall volume reduced to about one-half by heating at 60° C. The specified quantity of isopropyl alcohol was then added.

The coating mixture was applied to both sides of the cleaned titanium anode base in eight subsequent layers and following the same heating and cooling procedure between each coat and after the final coat as described in Example I.

The amounts of the three metals in the coating correspond to the weight ratios of 10% Ru, 10% Ir and 80% Ta, and the amount of noble metal in the coating corresponds to 0.2 mg Ir and 0.2 mg Ru per square centimeter of projected electrode area. In accelerated testing, this amode showed a weight loss of 0.0207 mg/cm$^2$ after three current reversals and a loss of 0.0138 after two amalgam dips. After 514 hours of operation, this anode showed a weight decrease of 0.097 mg/cm$^2$.

EXAMPLE V

Titanium trichloride in HCl solution is dissolved in methanol, the $TiCl_3$ is converted to the pertitanate by the addition of $H_2O_2$. This conversion is indicated by a change in color from $TiCl_3$ (purple) to $Ti_2O_5$ (orange). An excess of $H_2O_2$ is used to insure complete conversion to the pertitanate. Sufficient $RuCl_3 . 3H_2O$ is dissolved in methanol to give the desired final ratio of $TiO_2$ to $RuO_2$. The solution of pertitanic acid and ruthenium trichloride are mixed and the resulting solution is applied to both sides of a cleaned titanium anode surface and to the intermediate surfaces by brushing. The coating is applied as a series of coats with baking at about 350° C for 5 minutes between each coat. After a coating of the desired thickness or weight per unit of area has been applied, the deposit is given a final heat treatment at about 450° C for fifteen minutes to one hour. The molar ratio of $TiO_2$ to $RuO_2$ may vary from 1:1 $TiO_2$ : $RuO_2$ to 10:1 $TiO_2$ : $RuO_2$. The molar values correspond to 22.3:47 weight percent Ti : Ru and 51:10.8 weight percent Ti : Ru.

Anodes produced according to this example will resist amalgam immersion and have a high electrochemical activity in chlorine cells which continues without material diminution over a long period of time.

The thickness of the coating may be varied according to the electrochemical needs. A typical coating to give 46 mg Ru metal and 80 mg titanium in the oxide coating for every 6 sq. in. of anode surface may be prepared by using 117.9 mg $RuCl_3 . 3H_2O$ (39% Ru metal) and 80 mg of titanium metal as $TiCl_3$ (80 mg Ti dissolved in dilute HCl sufficiently in excess to maintain acidic conditions). Methanol is added to the titanium trichloride solution and the solution is oxidized with $H_2O_2$ to produce the pertitanate. The resulting solution is painted on a titanium anode substrate in multiple coats with drying or baking at 350° C for 5 minutes between each coat. Thirteen coats were required before all the solution was applied. A final heat treatment at 450° C for one hour was given to complete the semi-conductive coating. The molar ratio of Ti to Ru or $TiO_2$ to $RuO_2$ was 3.65:1.

EXAMPLE VI

An expanded titanium anode plate of the same size as in the former examples, after cleaning and etching, was given a liquid coating containing the following materials:

| | |
|---|---|
| Ruthenium as $RuCl_3 . H_2O$ | 11.25 mg (metal) |
| Gold as $HAuCl_4 . nH_2O$ | 3.75 mg (metal) |
| Titanium as $TiCl_3$ | 60 mg (metal) |
| Isopropyl alcohol | 5 – 10 drops |
| Hydrogen peroxide (30%) | 2 – 3 drops |

The coating was prepared by first blending the ruthenium and gold salts in the required amount in a 2 molar solution of hydrochloric acid (5 ml) and allowing the mixture to dry at a temperature of 50° C. The commercial solution of $TiCl_3$ was then added to the Ru-Au salt mixture and a few drops of hydrogen peroxide were stirred into the solution, sufficient to make the solution turn from blue to orange. Isopropyl alcohol was finally added in the required amount. The coating mixture thus prepared was applied to both sides of the cleaned titanium anode base in eight subsequent layers, following the same heating and cooling procedure as described in Example I.

The amounts of the three metals in the coating correspond to the weight ratios of 15% Ru, 5% Au, 80% Ti and the amount of noble metal in the coating corresponds to 0.225 mg Ru and 0.075 mg Au per square centimeter of projected electrode area. In accelerated testing, this anode showed a weight loss of 0.030 mg/cm² after three current reversals and a loss of 0.043 mg/cm² after two amalgam dips. After 514 hours of operation this anode showed a weight change of +0.2 mg/cm².

The anodes produced according to Examples I to V showed the following advantages when compared to titanium base anodes covered with platinum group metals by electroplating or chemi-deposition.

TABLE I

| Sample | Accelerated Weight Loss Tests: Current Reversal mg/cm² | Amalgam Dip mg/cm² | Total |
|---|---|---|---|
| B (Ex. II) Ir 0.2 mg/cm² Ru 0.2 mg/cm² Ti 1.12 mg/cm² | zero | 0.152 | 0.152 |
| C (Ex. IV) Ir 0.2 mg/cm² | zero | 0.068 | 0.068 |

TABLE I-continued

| Sample | Accelerated Weight Loss Tests: Current Reversal mg/cm² | Amalgam Dip mg/cm² | Total |
|---|---|---|---|
| Ru 0.2 mg/cm² Ti 1.12 mg/cm² with black oxide treatment of titanium base D (Ex. V) | 0.0207 | 0.0138 | 0.0345 |
| Ir 0.2 mg/cm² Ru 0.2 mg/cm² Ta 1.6 mg/cm² E (Ex. VI) | 0.030 | 0.043 | 0.073 |
| Au 0.075 mg/cm² Ru 0.225 mg/cm² Ti 1.2 mg/cm² | | | |
| $RuO_2$ coat only on Ti base Ru 1 mg/cm² | 0.2 | 0.73 | 0.93 |

Weight losses on samples prepared according to Examples I to V were determined under simulated operating conditions and compared with weight losses determined under the same conditions on titanium base samples coated with a Pt-Ir alloy. The tests were conducted in NaCl saturated solution at 65° C and under an anodic current density of 1 A/cm². Anode potentials were measured by means of a Luggin tip against a saturated calomel electrode and converted to the normal hydrogen electrode scale. The relevant results are summarized in Table II. The integrated weight change, as shown in the next to last column, was positive, that is, increased, for most of the samples prepared according to Examples I to V; which is an indication that the coating, instead of gradually wearing off and thus decreasing its precious metal oxide content, tends to build up an additional amount of protective semi-conducting face which reaches stability after a short period of operation as shown by Sample C.

On the contrary, the results summarized in Table I show that even the best noble metal alloy coatings suffer a greater wear rate, during operation; while such wear rate is not necessarily to be imputed exclusively to the spalling or washing off of noble metals, it certainly involves also a substantial decrease of the noble metal content in the coating. The amount of noble metals is such noble metal alloy coatings, which is the amount necessary to obtain a satisfactory anode activity and a sufficiently long operating life, is from five to ten times greater than in the semi-conducting rutile or tantalum oxide coatings prepared according to the present invention.

TABLE II

| Sample | Coating Composition | | | Operating Hours at 1 A/cm² | Anode Pot. Volt (N.H.E.) | Integrated Weight Change, mg/cm² | Wear Rate Grams per-ton $Cl_2$ |
|---|---|---|---|---|---|---|---|
| B (Ex. II) | $IrO_2$ | (Ir 0.2 | mg/cm²) | 0 | 1.62 | 0 | — |
| | $RuO_2$ | (Ru 0.2 | mg/cm²) | 792 | 1.53 | + 0.3 (weight incr.) | 0 |
| | $TiO_2$ | (Ti 1.12 | mg/cm²) | 2000 | 1.59 | + 0.7 (weight incr.) | 0 |
| C (Ex. III) | $IrO_2$ | (Ir 0.4 | mg/cm²) | 0 | 1.35 | — | — |
| | $RuO_2$ | (Ru 0.4 | mg/cm²) | 860 | 1.36 | + 0.9 (increase) | 0 |
| | $TiO_2$ | (Ti 0.96 | mg/cm²) | 2300 | 1.38 | + 0.9 (increase) | 0 |
| D (Ex. IV) | $IrO_2$ | (Ir 0.2 | mg/cm²) | 0 | 1.50 | — | — |
| | $RuO_2$ | (Ru 0.2 | mg/cm²) | 552 | 1.44 | + 0.75 (increase) | 0 |
| | $TiO_2$ | (Ti 1.12 | mg/cm²) | 816 | 1.50 | + 0.4 | 0 |
| E (Ex. V) | $IrO_2$ | (Ir 0.2 | mg/cm²) | 0 | 1.45 | — | — |
| | $RuO_2$ | (Ru 0.2 | mg/cm²) | 514 | 1.45 | − 0.097 (decrease) | 0.15 |
| | $TaO_2$ | (Ta 1.6 | mg/cm²) | | | | |
| F (Ex. VI) | $Au_2O_3$ | (Au 0.075 | mg/cm²) | 0 | 1.48 | — | — |
| | $RuO_2$ | (Ru 0.225 | mg/cm²) | 514 | 1.48 | + 0.2 (increase) | 0 |
| | $TiO_2$ | (Ti 1.2 | mg/cm²) | | | | |

TABLE II-continued

| Sample | Coating Composition | | Operating Hours at 1 A/cm² | Anode Pot. Volt (N.H.E.) | Integrated Weight Change, mg/cm² | Wear Rate Grams per-ton $Cl_2$ |
|---|---|---|---|---|---|---|
| G | Pt | ( 1.44 mg/cm²) | 0 | 1.36 | — | — |
| | Ir | ( 3.36 mg/cm²) | 1032 | 1.48 | − 0.25 (decrease) | 0.26 |
| | | | 2370 | 1.58 | − 0.9 | (decrease) 0.32 |
| H | Pt | ( 3.68 mg/cm²) | 0 | 1.39 | — | — |
| | Ir | ( 0.92 mg/cm²) | 926 | 1.35 | — | — |
| | | | 2940 | 1.39 | − 0.6 | 0.18 |

The average thickness of the final coating of Examples I to V is 1.45 microns or 57 micro-inches and the ratio of platinum group metals to non-precious metals in the oxide coatings of the catalytically active semiconductor coatings of Examples I to V may be between 20 to 100 and 85 to 100.

EXAMPLE VII

An expanded titanium anode plate was submitted to a cleaning and etching procedure and then given a liquid coating containing the following materials:

| | |
|---|---|
| Ruthenium as $RuCl_3 . 3H_2O$ | 0.8 mg/cm² (metal) |
| Titanium as $TiCl_3$ | 0.89 mg/cm² (metal) |
| Tantalum as $TaCl_5$ | 0.089 mg/cm² (metal) |

The coating mixture was prepared by first blending the dry ruthenium salt in the commercial hydrochloric acid solution containing 15% $TiCl_3$. Tantalum was then added in the above proportion and in the form of a solution of 50 g/l $TaCl_5$ in 20% HCl. The blue color of the solution was made to turn from blue to orange by introducing the necessary amount of hydrogen peroxide, which was followed by an addition of isopropyl alcohol as a thickening agent. The coating mixture was applied to both sides of the titanium anode base by electrostatic spray coating in four subsequent layers. The number of layers can be varied and it is sometimes preferable to apply several coats on the area facing the cathode and only one coat, preferably, the first coat, on the area away from the cathode. After applying each layer, the anode was heated in an oven under forced air culation at a temperature between 300° and 350° C for 10 to 15 minutes, followed by fast natural cooling in air between each of the first three layers and after the fourth layer was applied the anode was heated at 450° C for one hour under forced air circulation and then cooled.

The amounts of the three metals in the coating correspond to the weight ratios of 45% Ru, 50% Ti, 5% Ta. The $Ta_2O_5$ acted as the doping agent for the $TiO_2$ to increase the conductivity or semi-conductivity of the $TiO_2$ in the coating.

In accelerated testing this anode showed no appreciable weight loss after two current reversal cycles and after two amalgam dips. Each current reversal cycle consisted of a sequence of five anodic polarizations at 1 A/cm², each lasting two minutes and followed by a cathodic polarization at the same current density and for the same time. After more than 1500 hours of operation at 3 A/cm² in saturated sodium chloride solution, the anode potential was 1.41 V.

EXAMPLE VIII

An expanded titanium anode plate was submitted to a cleaning and etching procedure and then given a liquid coating containing the following materials:

| | |
|---|---|
| Ruthenium as $RuCl_3 . 3H_2O$ | 0.6 mg/cm² (metal) |
| Titanium as $TiCl_3$ | 0.94 mg/cm² (metal) |
| Tin as $SnCl_4$ | 0.17 mg/cm² (metal) |

The coating was prepared by first blending the dry ruthenium salt in the commercial hydrochloric acid solution with 15% $TiCl_3$. Tin tetrachloride was then stirred into the mixture in the above proportion, followed by sufficient hydrogen peroxide to cause the blue color of the solution to turn to orange. Isopropyl alcohol was added as a thickening agent. The coating mixture was applied to both sides of the pre-cleaned and pre-etched titanium anode base in four subsequent layers and each layer was submitted to the usual thermal treatment as described in Example VII. The amounts of the three metals in the coating correspond to the weight ratios of 35% Ru, 55% Ti, 10% Sn. In accelerated testing the anode showed a weight loss of 0.09 mg/cm² after two current reversal cycles as described in Example VII and a weight loss of 0.01 mg/cm² after one amalgam dip. After more than 1500 hours of operation in concentrated NaCl solution at 2 A/cm² and 60° C, the anode potential was 1.42 V.

EXAMPLE IX

A pre-cleaned titanium anode plate was coated with a coating mixture consisting of a hydrochloric acid solution containing the following salts:

| | |
|---|---|
| Ruthenium as $RuCl_3 . 3H_2O$ | 0.8 mg/cm² (metal) |
| Titanium as $TiCl_3$ | 0.96 mg/cm² (metal) |
| Aluminum as $AlCl_3 . 6H_2O$ | 0.018 mg/cm² (metal) |

The mixture was prepared by first blending the ruthenium and titanium salts in the commercial hydrochloric acid solution of $TiCl_3$, as described in the former examples. Aluminum trichloride was added in the above proportion, followed by treatment with hydrogen peroxide as in Example VII and isopropyl alcohol was added as a thickening agent. The mixture was applied to the pre-cleaned and pre-etched titanium anode base in four subsequent layers, taking care to apply the coating to both sides of the base and to the exposed areas between the top and bottom surfaces of the anode base. Thermal treatment procedure after each layer was as described in Example VI.

The amounts of the three metals in the coating correspond to weight ratios of 45% Ru, 54% Ti, and 1% Al.

After one current reversal cycle and two amalgam dips, the overall weight loss was 0.1 mg/cm². After operating for more than 1500 hours in concentrated sodium chloride solution at 60° C under an anodic current density of 3A/cm², the anode potential was 1.42 V.

X-ray diffraction analysis indicates that the coatings on the above anodes are in the form of semi-conducting rutile in which the doping oxides have become diffused in the rutile crystals by solid solution to give the valve metal anode base a semi-conducting rutile face with a chlorine discharge catalyst with ability to oxidize dissolved chloride ions to molecular chlorine gas. The chlorine discharge catalyst is preferably an oxide of a platinum group metal. The coatings may be applied and fixed upon tantalum electrode bases in a similar manner.

While semi-conducting faces may be applied to titanium or tantalum bases with other doping compositions, our tests so far have shown that when using the formulations and deposition methods described, the presence of titanium or tantalum oxide and iridium alone, i.e., without ruthenium oxide, give a deposit of low electrocatalytic activity with a higher chlorine discharge potential.

EXAMPLE X

The coating mixture consisted of an HCl solution containing the following salts:

| | |
|---|---|
| Manganese as $Mn(NO_3)_2$ | 0.5 mg/cm² (metal) |
| Tin as $SnCl_4 . 5H_2O$ | 0.5 mg/cm² (metal) |

The solution was prepared by first blending the two salts in 0.5 ml of 20% HCl for each mg of overall salt amount, and then adding 0.5 ml of formamide. The solution was heated at 40°–45° C until reaching complete dissolution, and then applied in six subsequent coatings on the pre-etched titanium base with a thermal treatment after each layer as formerly described. The amount of the two metals in the coating corresponds to the weight ratios of 50% Mn and 50% Sn. The anodic potential under chlorine discharge is saturated brine at 60° C was 1.98 V at the current density of 1 A/cm².

EXAMPLE XI

Using the same procedure as described in Example IX, the following binary salt mixture was applied to the titanium base electrode:

| | |
|---|---|
| Molybdenum as $Mo_2(NH_4)_2O_7$ | 0.5 mg/cm² (metal) |
| Iron as $FeCl_3$ | 0.5 mg/cm² (metal) |

The amount of the two metals in the coating corresponds to the weight ratios of 50% Mo and 50% Fe.

The anodic potential measured as in Example IX was 2. O.V.

EXAMPLE XII

Using the same procedure as in Example IX, the following binary mixture was applied to a titanium base electrode:

| | |
|---|---|
| Cobalt as $CoCl_2$ | 0.5 mg/cm² (metal) |

-continued

| | |
|---|---|
| Antimony as $SbCl_3 . (COOH)_2(CHOH)_2$ | 0.5 mg/cm² (metal) |

The amount of the two metals in the coating corresponds to the weight ratios of 50% Co and 50% Sb.

The anodic potential measured as in the former examples was 2.05 V.

EXAMPLE XIII

The binary mixture applied to the titanium base electrode according to the procedure of former Example IX was as follows:

| | |
|---|---|
| Rhenium as $(NH_4)_2ReCl_6$ | 0.5 mg/cm² (metal) |
| Iron as $FeCl_3$ | 0.5 mg/cm² (metal) |

The amount of the two metals in the coating corresponds to the weight ratios of 50% Re and 50% Fe.

The anodic potential measured as in the former examples was 1.46 V.

EXAMPLE XIV

The binary mixture applied to the titanium base electrode consisted of the following salts:

| | |
|---|---|
| Rhenium as $(NH_4)_2ReCl_6$ | 0.5 mg/cm² (metal) |
| Manganese as $Mn(NO_3)_2$ | 0.5 mg/cm² (metal) |

The mixture was prepared and applied following the same procedure as described for the former examples, with multiple coats with heating between each coat and after the final coat.

The amount of the two metals in the coating corresponds to the weight ratios of 50% Re and 50% Mn. The anodic potential in saturated sodium chloride brine at 60° C and at 1 A/cm² was 1.8 V.

EXAMPLE XV

The binary mixture applied to the titanium base electrode consisted of the following salts:

| | |
|---|---|
| Rhenium as $(NH_4)_2ReCl_6$ | 0.5 mg/cm² (metal) |
| Zinc as $ZnCl_2$ | 0.5 mg/cm² (metal) |

It was prepared and applied as described in Example IX.

The amount of the two metals in the coating corresponds to the weight ratios of 50% Re and 50% Zn. The anodic potential under the same conditions was 1.40 V.

EXAMPLE XVI

A mixture of three salts in HCL solution was applied to the titanium base electrode, as follows:

| | |
|---|---|
| Rhenium as $(NH_4)_2ReCl_6$ | 0.4 mg/cm² (metal) |
| Iron as $FeCl_3$ | 0.3 mg/cm² (metal) |
| Tin as $SnCl_4 . 5H_2O$ | 0.3 mg/cm² (metal) |

The salts were dissolved in a mixture composed of 0.5 ml of 20% HCL and 0.5 ml of formamide for each mg of overall metal amount. The mixture was applied on a pre-etched titanium base and on a pre-etched tantalum base, as described in Example XI. The amount of the three metals in the coating corresponds to the weight ratios of 40% Re, 30% Fe and 30% Sn. In both cases, the anodic potential in saturated NaCl solution and at 1 A/cm² was 1.58 V.

EXAMPLE XVII

Electrodes were made with five different coating types, each of which consisted of a four-component salt mixture including a ruthenium salt.

Sample No. 1

| | | Wt. % Metal |
|---|---|---|
| Titanium as $TiCl_3$ in HCl solution (commercial) | 1.14 mg/cm² (metal) | 65% Ti |
| Vanadium as $VOCl_2 . 2H_2O$ in HCl solution (commercial | 0.071 mg/cm² (metal) | 4% V |
| Tantalum as $TaCl_5$ in HCl solution (commercial) | 0.017 mg/cm² (metal) | 1% Ta |
| Ruthenium as $RuCl_3 . 3H_2O$ | 0.53 mg/cm² (metal) | 30% Ru |

Sample No. 2

| | | Wt. % Metal |
|---|---|---|
| Titanium as $TiCl_3$ in HCl solution (commercial) | 1.06 mg/cm² (metal) | 60% Ti |
| Tantalum as $TaCl_5$ in HCl solution (commercial) | 0.088 mg/cm² (metal) | 5% Ta |
| Tin as $SnCl_4 . 5H_2O$ | 0.088 mg/cm² (metal) | 5% Sn |
| Ruthenium as $RuCl_3 . 3H_2O$ | 0.53 mg/cm² (metal) | 30% Ru |

Sample No. 3

| | | Wt. % Metal |
|---|---|---|
| Titanium as $TiCl_3$ in HCl solution (commercial) | 0.96 mg/cm² (metal) | 53.0% Ti |
| Lanthanum as $La(NO_3)_3 . 8H_2O$ | 0.071 mg/cm² (metal) | 3.9% La |
| Tin as $SnCl_4 . 5H_2O$ | 0.25 mg/cm² (metal) | 13.8% Sn |
| Ruthenium as $RuCl_3 . 3H_2O$ | 0.53 mg/cm² (metal) | 29.3% Ru |

Sample No. 4

| | | Wt. % Metal |
|---|---|---|
| Titanium as $TiCl_3$ in HCl solution (commercial | 1.07 mg/cm² (metal) | 60% Ti |
| Chromium as $Cr(NO_3)_3 . 8H_2O$ | 0.088 mg/cm² (metal) | 5% Cr |
| Tin as $SnCl_4 . 5H_2O$ | 0.088 mg/cm² (metal) | 5% Sn |
| Ruthenium as $RuCl_3 . 3H_2O$ | 0.53 mg/cm² (metal) | 30% Ru |

Sample No. 5

| | | Wt. % Metal |
|---|---|---|
| Titanium as $TiCl_3$ in HCl solution (commercial) | 0.88 mg/cm² (metal) | 78.0% Ti |
| Aluminum as $AlCl_3 . 6H_2O$ | 0.088 mg/cm² (metal) | 7.8% Al |
| Tin as $SnCl_4 . 5H_2O$ | 0.088 mg/cm² (metal) | 7.8% Sn |
| Ruthenium as $RuCl_3 . 3H_2O$ | 0.071 mg/cm² (metal) | 6.4% Ru |

Each sample was prepared by first blending the ruthenium salt in the commercial hydrochloric acid solution of $TiCl_3$ and adding hydrogen peroxide in the amount required to obtain a color change from blue to red. To this mixture were added the other salts in the stated proportions plus 0.56 ml of isopropanol for each mg of overall metal amount. The five mixtures were applied on five separate titanium plates in five subsequent coatings. Heat treatment at 350° C for 10 minutes was given between each coating and the next. A final treatment at 450° C for 1 hour followed the last coating.

Anodic tests were carried out in saturated NaCl brine at 60° C at a current density of 1 A/cm². The measured electrode potentials were as follows:

| | |
|---|---|
| Sample No. 1 | 1.42 V |
| Sample No. 2 | 1.40 V |
| Sample No. 3 | 1.39 V |
| Sample No. 4 | 1.44 V |
| Sample No. 5 | 1.39 V |

EXAMPLE XVIII

Four coating types were tested, each of which consisted of a four component salt mixture, including a noble metal salt.

Sample No. 1

| | | Wt. % Metal |
|---|---|---|
| Titanium as $TiCl_3$ in HCL | 0.7 mg/cm² metal | 39.2% Ti |

-continued

| | | Wt. % Metal |
|---|---|---|
| solution (commercial) | | |
| Lanthanum as $La(NO_3)_3.8H_2O$ | 0.088 mg/cm² metal | 4.9% La |
| Tin as $SnCl_4.5H_2O$ | 0.15 mg/cm² metal | 8.4% Sn |
| Platinum as $PtCl_4.nH_2O$ (commerical) | 0.85 mg/cm² metal | 47.5% Pt |

Sample No. 2

| | | Wt. % Metal |
|---|---|---|
| Titanium as $TiCl_3$ in HCl solution (commercial) | 0.7 mg/cm² metal | 39.2% Ti |
| Lanthanum as $La(NO_3)_3.8H_2O$ | 0.088 mg/cm² metal | 4.9% La |
| Tin as $SnCl_4.5H_2O$ | 0.15 mg/cm² metal | 8.4% Sn |
| Rhodium as $(NH_4)_2RhCl_6$ | 0.85 mg/cm² metal | 47.5% Rh |

Sample No. 3

| | | Wt. % Metal |
|---|---|---|
| Titanium as $TiCl_3$ in HCl solution (commercial) | 0.7 mg/cm² metal | 39.2% Ti |
| Aluminum as $AlCl_3.6H_2O$ | 0.088 mg/cm² metal | 4.9% Al |
| Tin as $SnCl_4.5H_2O$ | 0.15 mg/cm² metal | 8.4% Sn |
| Iridium $IrCl_4$ | 0.85 mg/cm² metal | 47.5% Ir |

Sample No. 4

| | | Wt. % Metal |
|---|---|---|
| Titanium as $TiCl_3$ in HCl solution (commercial) | 0.7 mg/cm² (metal) | 39.2% Ti |
| Aluminum as $AlCl_3.6H_2O$ | 0.088 mg/cm² (metal) | 4.9% Al |
| Tin as $SnCl_4.5H_2O$ | 0.15 mg/cm² (metal) | 8.4% Sn |
| Palladium as $PdCl_2$ | 0.85 mg/cm² (metal) | 47.5% Pd |

The four mixtures were applied on five separate titanium and on five separate tantalum plates in five subsequent coatings. Intermediate and final heat treatments were given as in Example XVII. The anodic potentials, measured under the same conditions as in the former example, were the following:

| | |
|---|---|
| Sample No. 1 | 1.45 V |
| Sample No. 2 | 1.85 V |
| Sample No. 3 | 1.37 V |
| Sample No. 4 | 1.39 V |

EXAMPLE XIX

Electrodes were made with five different coating types, each of which consisted of a four-component salt mixture including a ruthenium salt, a titanium salt and a salt of a metal having an atomic valence different from titanium and acting as a doping agent for titanium dioxide. These coatings were applied to an expanded titanium sheet which had been cleaned by boiling at a reflux temperature of 109° C in a 20% solution of hydrochloric acid for 20 minutes, in the amounts specified per square centimeter of projected electrode area.

Sample No. 1

| | | Wt. % Metal |
|---|---|---|
| Ruthenium as $RuCl_3 . 3H_2O$ | 1.60 mg/cm² (metal) | 45% Ru |
| Aluminum as $AlCl_3 . 6H_2O$ | 0.036 mg/cm² (metal) | 1% Al |
| Tin as $SnCl_4 . 5H_2O$ | 0.142 mg/cm² (metal) | 4% Sn |
| Titanium as $TiCl_3$ | 1.78 | 50% Ti |

This coating was prepared by first blending ruthenium, aluminum and tin salts in the required amount. $TiCl_3$ solution (15% as $TiCl_3$ in commercial solution) was then slowly added under stirring.

After the salts were completely dissolved, a few drops of hydrogen peroxide ($H_2O_2$ 30%) were added, sufficient to make the solution turn from the blue of the commercial $TiCl_3$ solution to the brown-reddish color of a peroxyhydrate compound.

At the end, a few drops of isopropyl alcohol are added to the solution after cooling. The coating, thus prepared, was applied to the working side of the cleaned titanium expanded mesh surface by brush or spraying in 10 to 14 subsequent layers. After applying each layer, the sample was heated in an oven under forced air circulation at a temperature between 300° to 400° C for 5 to 10 minutes, followed by fast natural cooling in air between each of the first 10 to 14 layers and after the last coat was applied, the sample was heated at 450° C for one hour under forced air circulation and then cooled.

In our standard accelerated testing, this sample showed a weight loss of zero after current reversals and a loss of 0.2 to 0.3 mg/cm² after three amalgam dips. After 11,000 hours of operation at 30 kA/m² in saturated NaCl brine and 60° C, the electrode as an anode showed a weight loss of zero and an anode potential of 1.38 V (NHE).

Sample No. 2

This coating was applied to a cleaned titanium expanded mesh anode base according to the procedure of Sample No. 1, and consisted of the following materials:

| | | Wt. % Metal |
|---|---|---|
| Ruthenium as $RuCl_3 . 3H_2O$ | 1.60 mg/cm² (metal) | 45% Ru |
| Cobalt as $CoCl_2 . 6H_2O$ | 0.036 mg/cm² (metal) | 1% Co |
| Tin as $SnCl_4 . 5H_2O$ | 0.142 mg/cm² (metal) | 4% Sn |
| Titanium as 15% $TiCl_3$ solution (commercial) | 1.78 mg/cm² (metal) | 50% Ti |

The procedure for compounding the coating and applying it to the Ti base was the same as in Sample No. 1.

In our standard accelerated test, this sample showed a weight loss of zero after current reversals and a loss of 0.2 to 0.4 mg/cm² after three amalgam dips. After 10,000 hours of operation as an anode at 30 kA/m² in saturated NaCl brine and 65° C, the electrode showed a weight loss of zero and an anode potential of 1.36 to 1.37 V (NHE).

This coating has shown a higher electrocatalytic activity than any other formulation not containing iridium. A portion of the mixture $Co_2O_3$ + CoO may reverse the electrical conductivity of the semi-conductor from n to p type and other portions of the $Co_2O_3$ + CoO mixture may produce a spinel with $SnO_2$ introducing new electrocatalytic sites into the coating.

Sample No. 3

The coating was applied to a cleaned Ti anode base according to the procedure of Sample No. 1, and consisted of the following amounts:

| | | Wt. % Metal |
|---|---|---|
| Ruthenium as $RuCl_3 . 3H_2O$ | 1.6 mg/cm² (metal) | 45% Ru |
| Lanthanum as $LaCl_3 . 9H_2O$ | 0.036 mg/cm² (metal) | 1% La |
| Tin as $SnCl_4 . 5H_2O$ | 0.142 mg/cm² (metal) | 4% Sn |
| Titanium as $TiCl_3$ | 1.78 mg/cm² (metal) | 50% Ti |

The procedure for compounding the coating and applying it to the Ti base was the same as in Sample No. 1.

In accelerated test, the anode of this sample showed a weight loss of zero after current reversals and a loss of 0.3 to 0.5 mg/cm² after three amalgam dips. After 10,000 hours of operation, this electrode showed a weight loss of zero and an anode potential of 1.39 to 1.40 V (NHE) at 30 kA/m² in saturated NaCl brine and 65° C.

Sample No. 4

This coating mixture was applied to a cleaned Ti anode base according to the procedure of Sample No. 1 and consisted of the following materials:

| | | Wt. % Metal |
|---|---|---|
| Ruthenium as $RuCl_3 . 3H_2O$ | 1.60 mg/cm² (metal) | 45% Ru |
| Vanadium as $VaCl_3$ solution (commercial) | 0.036 mg/cm² (metal) | 1% Va |
| Tantalum as $TaCl_5$(20% HCl solution, 0.02 mg Ta/u) | 0.142 mg/cm² (metal) | 4% Ta |
| Titanium as 15% $TiCl_3$ | 1.78 mg/cm² (metal) | 50% Ti |

The procedure for compounding the coating and applying it to the Ti base was the same as in Sample No. 1. After 11,000 hours of operation as an anode, the sample showed a weight loss of zero and an anode potential of 1.38 V (NHE) at 30 kA/m² in saturated NaCl brine and 65° C.

Sample No. 5

This coating was applied to a cleaned Ti base according to the procedure of Sample No. 1 and consisted of the following materials:

| | | Wt. % Metal |
|---|---|---|
| Ruthenium as $RuCl_3 . 3H_2O$ | 1.6 mg/cm² (metal) | 45% Ru |
| Chromium as $Cr(NO_3)_3 . 8H_2O$ | 0.036 mg/cm² (metal) | 1% Cr |
| Tin as $SnCl_4 . 5H_2O$ | 0.142 mg/cm² (metal) | 4% Sn |
| Titanium as 15% $TiCl_3$ solution (commercial) | 1.78 mg/cm² (metal) | 50% Ti |

The procedure for compounding the coating and applying it to the Ti base was the same as in Sample No. 1. After 5,000 hours of operation as an anode, the sample showed a weight loss of zero and an anode potential of 1.37 V (NHE) at 30 mA/m² in saturated NaCl brine and 65° C.

Each sample was prepared by blending the three salts first enumerated under each of Samples 1 to 5, in the required amounts. The titanium chloride solution (15% as TiCl 3 in commercial solution) was then slowly added to the blended mixture of the first three salts under stirring. After all the salts were completely dissolved, a few drops (3 to 5) of hydrogen peroxide ($H_2O_2$ 50%) were added, sufficient to make the solution turn from the blue of the commercial $TiCl_3$ solution to the brown-reddish color of a peroxyhydrate compound. At the end of the mixing, a few drops of isopropyl alcohol were added to the solution after cooling.

The coatings thus prepared were applied to the working side of the cleaned titanium surface by brush or spraying in 10 to 14 subsequent layers. After each layer, the sample was heated in an oven under forced air circulation at a temperature between 300° to 400° C for 5 to 10 minutes, followed by fast natural cooling in air between each layer and after the last layer was applied, the sample was heated at 450° C for one hour under forced air circulation and then cooled.

In standard accelerated tests the samples showed the following weight loss.

| | Weight Loss After Current Reversals | Weight Loss After 3 Amalgam Dips |
|---|---|---|
| Sample No. 1 | 0 | 0.2 to 0.3 mg/cm² |
| Sample No. 2 | 0 | 0.2 to 0.4 mg/cm² |
| Sample No. 3 | 0 | 0.3 to 0.5 mg/cm² |
| Sample No. 4 | | |
| Sample No. 5 | | |

| | Hours of Operation | Weight Loss | Anodic Potential |
|---|---|---|---|
| Sample No. 1 | 11,000 | 0 | 1.38 V (NHE) |
| Sample No. 2 | 10,000 | 0 | 1.36 to 1.37 V (NHE) |
| Sample No. 3 | 10,000 | 0 | 1.39 to 1.40 V (NHE) |
| Sample No. 4 | 11,000 | 0 | 1.38 V (NHE) |
| Sample No. 5 | 5,000 | 0 | 1.37 V (NHE) |

EXAMPLE XX

An expanded titanium sheet was etched with boiling HCl 20% solution at reflux temperature (109° C) for 40 minutes and then coated with the following:

Sample No. 1

| | | Wt. % Metal |
|---|---|---|
| Ruthenium as $RuCl_3 . 3H_2O$ | 1.6 mg/cm² (metal) | 45% Ru |
| Iron as $FeCl_2 . 6H_2O$ | 0.036 mg/cm² (metal) | 1% Fe |
| Tin as $SnCl_4 . 5H_2O$ | 0.142 mg/cm² (metal) | 4% Sn |
| Titanium as $TiCl_3$ | 1.78 mg/cm² (metal) | 50% Ti |
| Hydrogen peroxide $H_2O_2$ 30% | 3 to 5 drops | |
| Isopropyl alcohol $CH_3CHOHCH_3$ 99% | 4 to 6 drops | |

This coating was prepared by blending the ruthenium, iron and tin salts in the required amounts and the $TiCl_3$ solution (15% $TiCl_3$ in commercial solution) was slowly added under stirring. After the salts were completely dissolved, a few drops of hydrogen peroxide ($H_2O_2$ 30%) were added, sufficient to make the solution turn from the blue color of commercial $TiCl_3$ solution to the brown-reddish color of peroxyhydrate compound. After cooling, a few drops of isopropyl alcohol were added.

The coating, thus prepared, was applied to the working side of the etched titanium surface by brush or spraying in 10 to 14 subsequent layers. After applying each layer, the sample was heated in an oven at a temperature of 300° to 400° C for 10 minutes, followed by fast natural cooling in air between each of the first 10 to 14 layers.

After the last layer was applied, the sample was heated at 450° C for 1 hour under forced air circulation and then cooled.

On standard accelerated testing, the sample showed a weight loss of 0.2 mg/cm² after three amalgam dips. After 10,000 hours of operation at 30 kA/m² in saturated brine at 65° C, the electrode as an anode showed a weight loss of zero and an anode potential of 1.40 V (NHE).

Sample No. 2

An expanded titanium sheet was etched as described above, and was then coated with the following mixture:

| | | Wt. % Metal |
|---|---|---|
| Ruthenium as $RuCl_3 . 3H_2O$ | 1.6 mg/cm² (metal) | 45.5% Ru |
| Nickel as $NiCl_2 . 6H_2O$ | 0.036 mg/cm² (metal) | 1.0% Ni |
| Cobalt as $CoCl_2 . 6H_2O$ | 0.036 mg/cm² (metal) | 1.0% Co |
| Chromium as $Cr(NO_3)_3 . 9H_2O$ | 0.036 mg/cm² (metal) | 1.0% Cr |
| Tin as $SnCl_4 . 5H_2O$ | 0.036 mg/cm² (metal) | 1.0% Sn |
| Titanium as $TiCl_3$ | 1.78 mg/cm² (metal) | 50.5% Ti |
| Hydrogen peroxide $H_2O_2$ 30% | 3 to 5 drops | |
| Isopropyl alcohol $CH_3CHOHCH_3$ 99% | 4 to 6 drops | |

This coating was prepared by first blending the ruthenium, nickel, cobalt, chromium and tin salts in the required amounts and the $TiCl_3$ solution was slowly added under stirring. After the salts were completely dissolved, a few drops of hydrogen peroxide ($H_2O_2$ 30%) were added, sufficient to make the solution turn from the blue color of commercial $TiCl_3$ solution to the brown-reddish color of a peroxyhydrate compound. After cooling, a few drops of isopropyl alcohol were added.

The coating, thus prepared, was applied to the working side of the etched titanium according to the procedure used for the preceding Sample No. 1.

On accelerated tests, the sample showed a weight loss of 0.25 to 0.3 mg/cm² after three amalgam dips and a weight loss of zero after current reversals.

After 5,000 hours of operation at 30 kA/m² in saturated brine at 65° C, the electrode as an anode showed a weight loss of zero and an anode potential of 1.37 V (NHE).

Sample No. 3

An expanded titanium sheet was etched as described for sample No. 1, and was then coated with the following mixture:

| | | Wt. % Metal |
|---|---|---|
| Ruthenium as $RuCl_3 . 3H_2O$ | 1.6 mg/cm² as metal | 45.5% Ru |
| Nickel as $NiCl_2 . 6H_2O$ | 0.036 mg/cm² as metal | 1.0% Ni |
| Iron as $FeCl_2 . 6H_2O$ | 0.036 mg/cm² as metal | 1.0% Fe |
| Cobalt as $CoCl_2 . 6H_2O$ | 0.036 mg/cm² as metal | 1.0% Co |
| Chromium as $Cr(NO_3)_3 . 9H_2O$ | 0.036 mg/cm² as metal | 1.0% Cr |
| Titanium as $TiCl_3$ | 1.78 mg/cm² as metal | 50.5% Ti |
| Hydrogen peroxide $H_2O_2$ 30% | 3 to 5 drops | |
| Isopropyl alcohol $CH_3CHOHCH_3$ 99% | 4 to 6 drops | |

This coating was prepared by first blending the ruthenium, nickel, iron, cobalt and chromium salts in the required amounts and then adding the $TiCl_3$ solution slowly with stirring. After the salts were completely dissolved, a few drops of hydrogen peroxide ($H_2O_2$ 30%) were added, sufficient to make the solution turn from the blue color of commercial $TiCl_3$ solution to the brown-reddish color of a peroxyhydrate compound. After cooling, a few drops of isopropyl alcohol were added.

The coating, thus prepared, was applied to the working side of the etched titanium according to the procedure used for the preceding sample No. 1.

On accelerated tests, the sample showed a weight loss of zero after current reversals and a loss of 0.2 to 0.3 mg/cm² after three amalgam dips.

After 5,000 hours of operation at 30 kA/m² in saturated brine at 65° C, the electrode as an anode showed a weight loss of zero and an anode potential of 1.38 V (NHE).

The coating thus prepared was applied to the working side of the etched titanium surface by brush or spraying in 10 to 14 subsequent layers. After applying each layer, the sample was heated in an oven at a temperature of 300° to 400° C for 10 minutes, followed by fast natural cooling in air between each of the first 10 to 14 layers.

After the last layer was applied, the sample was heated at 450° C for 1 hour under forced air circulation and then cooled.

On standard accelerated testing, the sample showed a weight loss of zero after three amalgam dips. After 5,000 hours of operation at 30 kA/m² in saturated brine at 65° C, the electrode as an anode showed a weight loss of zero and an anode potential of 1.38 V (NHE).

Sample No. 2

An expanded titanium sheet was etched as described for sample No. 1, and was then coated with the following mixture:

| | | Wt. % Metal |
|---|---|---|
| Ruthenium as $RuCl_3 . 3H_2O$ | 1.6 mg/cm² as metal | 45% Ru |
| Cobalt as $CoCl_2 . 6H_2O$ | 0.178 mg/cm² as metal | 5% Co |
| Titanium as $TiCl_3$ | 1.78 | 50% Ti |
| Hydrogen peroxide $H_2O_2$ 30% | 3 to 5 drops | |
| Isopropyl alcohol $CH_3CHOHCH_3$ 99% | 4 to 6 drops | |

This coating was prepared by first blending the ruthenium and cobalt salts in the required amounts and the $TiCl_3$ solution was slowly added under stirring. After the salts were completely dissolved, a few drops of hydrogen peroxide ($H_2O_2$ 30%) were added, sufficient to make the solution turn from the blue color of commercial $TiCl_3$ solution to the brown-reddish color of a peroxyhydrate compound. After cooling, a few drops of isopropyl alcohol were added.

The coating, thus prepared, was applied to the working side of the etched titanium according to the procedure used for the preceding Sample No. 1.

After accelerated tests, the sample showed a weight loss of zero after current reversals and a loss of 0.2 mg/cm² after three amalgam dips.

After 5,000 hours of operation at 30 kA/m² in saturated brine at 65° C, the electrode as an anode showed

EXAMPLE XXI

An expanded titanium sheet was etched with boiling HCl 20% solution at reflux temperature (109° C) for 40 minutes and then coated with the following:

Sample No. 1

| | | Wt. % Metal |
|---|---|---|
| Ruthenium as $RuCl_3 . 3H_2O$ | 1.6 mg/cm² as metal | 45% Ru |
| Nickel as $NiCl_2 . 6H_2O$ | 0.178 mg/cm² as metal | 5% Ni |
| Titanium as $TiCl_3$ | 1.78 mg/cm² as metal | 50% Ti |
| Hydrogen peroxide $H_2O_2$ 30% | 3 to 5 drops | |
| Isopropyl alcohol $CH_3CHOHCH_3$ | 4 to 6 drops | |

This coating was prepared by blending the ruthenium, nickel and titanium salts in the required amounts and the $TiCl_3$ solution (15% $TiCl_3$ in commercial solution) was slowly added under stirring. After the salts were completely dissolved, a few drops of hydrogen peroxide ($H_2O_2$ 30%) were added, sufficient to make the solution turn from the blue color of commercial $TiCl_3$ solution to the brown-reddish color of a peroxyhydrate compound. After cooling, a few drops of isopropyl alcohol were added.

a weight loss of zero and an anode potential of 1.38 V (NHE).

Sample No. 3

An expanded titanium sheet was etched as described for sample No. 1, and was then coated with the following mixture:

| | | Wt. % Metal |
|---|---|---|
| Ruthenium as $RuCl_3 . 3H_2O$ | 1.6 mg/cm² as metal | 45% Ru |
| Iron as $FeCl_2 . 6H_20$ | 0.178 mg/cm² as metal | 5% Fe |
| Titanium as $TiCl_3$ | 1.78 | 50% Ti |
| Hydrogen peroxide $H_2O_2$ 30% | 3 to 5 drops | |
| Isopropyl alcohol $CH_3CHOHCH_3$ 99% | 4 to 6 drops | |

This coating was prepared by first blending the ruthenium and iron salts in the required amounts and then adding the $TiCl_3$ solution slowly with stirring. After the salts were completely dissolved, a few drops of hydrogen peroxide ($H_2O_2$ 30%) were added, sufficient to make the solution turn from the blue color of commercial $TiCl_3$ solution to the brown-reddish color of a peroxyhydrate compound. After cooling, a few drops of isopropyl alcohol were added.

The coating, thus prepared, was applied to the working side of the etched titanium according to the procedure used for the preceding sample No. 1.

After accelerated tests, the sample showed a weight loss of zero after current reversals and a loss of 0.2 to 0.3 mg/cm² after three amalgam dips.

After 5,000 hours of operation at 30 kA/m² in saturated brine at 65° C, the electrode as an anode showed a weight loss of zero and an anode potential of 1.38 V (NHE).

While we have given some theories to better describe our invention, these are for explanation only and we do not intend to be bound by these theories in the event it is shown that our invention works differently from the theories given.

The word "oxide" in the following claims is intended to cover oxides of titanium and tantalum whether in the form of $TiO_2$ and $Ta_2O_5$, or other oxides of these metals and oxides of other metals capable of forming semiconductive coatings with oxides of metals from adjacent groups of the Periodic Table, and the words "noble metals" is intended to include the platinum group metals and gold and silver. The titanium dioxide may be in rutile or anatase form.

The base of the electrode may be a valve metal or any metal capable of withstanding the corrosive conditions of an electrolytic chlorine cell, such as high silicon iron (Duriron), cast or pressed magnetite, etc. Our preference, however, is for a titanium or tantalum base.

The electrodes of our invention may be used in any liquid phase or gaseous phase electrolyte, particularly aqueous salt solutions or fused salts. They are dimensionally stable and are not consumed in the electrolytic process and when used in alkali halide electrolytes such as, for example, sodium chloride solutions used for the production of chlorine and sodium hydroxide, our electrodes form the anodes and the cathodes may be mercury, steel or other suitable conductive material. In mercury cells such as typified, for example, in U.S. Pat. No. 3,042,602 or No. 2,958,635, or in diaphragm cells such as U.S. Pat. No. 2,987,463, our electrodes are the anodes and are used in place of the graphite anodes shown in these patents and heretofore used in cells of this type.

The semi-conductor coatings conduct the electrolyzing current from the anode bases to the electrolyte through which it flows to the cathode.

Various modifications and changes may be made in the steps described and the solutions and compositions used without departing from the spirit of our invention or the scope of the following claims.

What is claimed is:

1. An electrode comprising a metal base from the group consisting of titanium and tantalum, having over at least a portion of the base a coating containing oxides of rhenium, together with oxides from the group consisting of iron, manganese, zinc and tin and mixtures of oxides from the group consisting of iron, manganese, zinc and tin.

2. The electrode of claim 1, in which the rhenium comprises 40% to 50% of the coating, and the remainder comprises oxides from the group consisting of iron and zinc, said percentages being based upon the weight of the metals in said coating and the metals in said coating being in the form of oxides.

3. An electrode comprising a valve metal base from the group consisting of titanium and tantalum, an electrically conducting electrocatalytic coating on said valve metal base containing an electrocatalytic agent from the group consisting of rhenium, iron, manganese, zinc and the platinum group metals and up to 50% tin, said coating being in the form of oxides of said metals and said percentages being based upon the weight of the metals in said coating.

4. An electrode comprising a valve metal base from the group consisting of titanium and tantalum, an electrically conducting electrocatalytic coating on said valve metal base containing 39.2% to 78% of an oxide of titanium, 6.4% to 47.5% of an oxide of a platinum group metal and 1% to 17.7% of an oxide of a doping metal from the group consisting of tin, vanadium, lanthanum, cobalt, and mixtures thereo, the said percentages being based upon the weight of the metals in said oxides.

5. The electrode of claim 4, in which said remainder comprises 1% to 5% of an oxide of cobalt and of an oxide from the group consisting of tin, chromium, iron, nickel, and mixtures thereof.

6. An electrode comprising a valve metal base from the group consisting of titanium and tantalum, an electrically conducting electrocatalytic coating on said valve metal base containing 39.2% to 78% of an oxide of titanium, 6.4% to 47.5% of at least one oxide of a platinum group metal and the remainder of which contains an oxide of tin and the oxide of one or more metals from the group consisting of tantalum, lanthanum, chromium, aluminum, iron, cobalt, and nickel, the said percentages being based on the weight of the metals in said coating, said coating being in several layers on said valve metal base.

7. The electrode of claim 6, in which the said remainder contains an oxide of tin in amounts of 1% to 13.8% and an oxide from the group consisting of cobalt, nickel, iron, tantalum, and mixtures thereof, in an amount of 1% to 5%, said percentages being based upon the weight of the metals in said coating.

8. The electrode of claim 6, in which the said coating includes two or more platinum group metal oxides.

9. The elctrode of claim 6, in which the coating contains 50% to 65% of titanium, 30% to 45% of ruthenium, and approximately 1% to 10% of metal from the group consisting of tin and cobalt, said percentages being based upon the weight of the metals in said coating and the metals in said coating being in the form of oxides.

10. The electrode of claim 6, in which the coating contains approximately 50% of titanium, approximately 45% of ruthenium and approximately 5% of tin and cobalt, said percentages being based upon the weight of the metals in said coating.

11. An electrode comprising a valve metal base having a coating thereon containing at least three metal oxides, said oxides, comprising 39% to 78% of an oxide of titanium, 16% to 47.5% of oxides of platinum group metals and 4% to 17.7% of an oxide selected from the group consisting of tin, vanadium, cobalt, and mixtures thereof, said percentages being based upon the weight of the metals in said oxides.

12. The electrode of claim 11, in which the said 4% to 17.7% amount is tin and one or more non-precious metals from the group consisting of cobalt, nickel and iron.

13. An electrode comprising a chlorine resistant metal base having a semi-conductor coating thereon containing (a) a platinum group metal oxide, (b) titanium dioxide and (c) a doping oxide from the group consisting of oxides of tin, lanthanum, aluminum, cobalt, antimony, molybdenum, tungsten, tantalum, vanadium, phosphorus, boron, beryllium, sodium, calcium, strontium, and mixtures thereof, the titanium dioxide in said coating constituting more than 50% of the total metals in said coating, the platinum group metal oxide constituting from 16% to 47.5% of the total metals in said coating and the doping oxide constituting from 4% to 17.7% of the total metals in said coating.

14. The electrode of claim 13, in which the chlorine resistant metal base is titanium, the platinum group metal compound is a ruthenium compound and the doping metal compound is from the group consisting of cobalt, tin, nickel, aluminum and lanthanum, and mixtures thereof.

15. An electrode comprising a chlorine resistant metal base from the group consisting of titanium and tantalum, having a coating thereon containing an oxide of a platinum group metal in the amount of 6.4% to 47.5% and a mixture of metal oxides forming a semiconductor coating on said base, said mixture of metal oxides forming the semi-conducting coating comprising a material from the group consisting of titanium dioxide and tantalum pentoxide in the amount of 39.2% to 78% of said coating and at least one doping oxide from the group consisting of an oxide of silver, tin, chromium, lanthanum, aluminum, cobalt, antimony, molybdenum, nickel, iron, tungsten, vanadium, phosphorus, boron, beryllium, sodium, calcium, strontium, copper and bismuth, and mixtures thereof, said percentages being based upon the weight of the metals in said oxides and the ratio of platinum group metals to the non-precious metals in said oxide coatings being between 20:100 and 85:100.

16. The electrode of claim 15, in which the coating is in multiple layers on the metal base and the doping oxide consists of tin in an amount of 1% to 50% and an oxide of at least one metal from the group consisting of manganese, iron, tantalum, lanthanum, chromium, cobalt, nickel and aluminum.

17. The electrode of claim 16, in which the coating includes oxides of two platinum group metals.

18. The electrode of claim 17, in which the oxides of platinum group metals are ruthenium oxide and iridium oxide.

19. An electrode comprising a chlorine resistant metal base from the group consisting of titanium and tantalum, having a semi-conductor coating thereon containing (a) a metal oxide from the group consisting of ruthenium, iridium, palladium, osmium and rhenium in the amount of 6.4% to 47.5%, (b) a metal oxide from the group consisting of titanium dioxide or tantalum pentoxide in the amount of 39.2% to 78%, and (c) a doping oxide from the group consisting of oxides of silver, tin, chromium, lanthanum, aluminum, cobalt, antimony, molybdenum, nickel, iron, tungsten, vanadium, phosphorus, boron, beryllium, sodium, calcium, strontium, copper and bismuth, and mixtures thereof, in the amount of 1% to 30%, the percentage of doping oxide being between 0.10% and 50% of the metal oxide from the group consisting of titanium dioxide and tantalum pentoxide and the ratio of platinum group metals to the non-precious metals in said oxide coatings being between 20:100 and 85:100, all said percentages being based upon the weight of the metal in said oxides.

20. An electrode comprising a chlorine resistant metal base from the group consisting of titanium and tantalum having a semi-conductor coating containing (a) ruthenium oxide, (b) titanium dioxide and (c) at least one doping oxide from the group consisting of oxides of tantalum, tin, lanthanum, cobalt, nickel, iron, vanadium and aluminum, and mixtures thereof.

21. The electrode of claim 20, in which the doping oxide consists of an oxide of tin, together with an oxide of a metal from the group consisting of tantalum, lanthanum, cobalt, nickel, iron and aluminum, and mixtures thereof.

* * * * *

UNITED STATES PATENT OFFICE

CERTIFICATE OF CORRECTION

Patent No. 4,003,817 Dated Jan. 18, 1977

Inventor(s) Giuseppe Bianchi, et al.

It is certified that error appears in the above-identified patent and that said Letters Patent are hereby corrected as shown below:

Col. 3 line 12. After "$TiO_2$" insert -- or $Ta_2O_5$ --.

Col. 4 line 54. "mixtures" (second occurrence) should be -- materials --.

Col. 6 line 47. After "300°" insert -- and 350° --.

Col.10 line 45. Change "is" to -- in --.

Col.11 line 49. "culation" should be -- circulation --.

Col.26 line 50. "thereo" should be -- thereof --.

Col.26 line 53. Change "4" to -- 6 --.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*